US010490897B1

(12) United States Patent
Grandfield et al.

(10) Patent No.: US 10,490,897 B1
(45) Date of Patent: Nov. 26, 2019

(54) FREQUENCY SELECTIVE SURFACE ANTENNA ELEMENT

(71) Applicant: The Charles Stark Draper Laboratory, Inc., Cambridge, MA (US)

(72) Inventors: John E. Grandfield, Plymouth, MA (US); Jacob P. Treadway, Lexington, MA (US); Amy E. Duwel, Cambridge, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 513 days.

(21) Appl. No.: 15/215,696

(22) Filed: Jul. 21, 2016

Related U.S. Application Data

(63) Continuation of application No. 14/870,869, filed on Sep. 30, 2015, now Pat. No. 9,748,642.

(60) Provisional application No. 62/095,125, filed on Dec. 22, 2014.

(51) Int. Cl.

| | |
|---|---|
| ***H01Q 15/00*** | (2006.01) |
| ***H01Q 7/00*** | (2006.01) |
| ***H01Q 1/48*** | (2006.01) |
| ***H01Q 9/04*** | (2006.01) |

(52) U.S. Cl.
CPC ..... *H01Q 7/005* (2013.01); *H01Q 1/48* (2013.01); *H01Q 9/0442* (2013.01)

(58) Field of Classification Search
CPC ..... H01Q 1/48; H01Q 9/04; H01Q 15/00–14
USPC ..... 343/700 MS, 909; 342/1–19
See application file for complete search history.

(56) References Cited

U.S. PATENT DOCUMENTS

| | | | | |
|---|---|---|---|---|
| 5,982,339 | A * | 11/1999 | Lalezari | H01Q 1/521 343/705 |
| 5,999,064 | A * | 12/1999 | Blacka | H01P 1/227 333/81 A |
| 6,208,316 | B1 * | 3/2001 | Cahill | H01Q 15/0033 333/134 |
| 6,933,812 | B2 | 8/2005 | Sarabandi et al. | 333/219 |
| 7,079,079 | B2 * | 7/2006 | Jo | H01Q 1/243 343/700 MS |
| 8,271,241 | B2 | 9/2012 | Akyurtlu et al. | 703/5 |
| 2007/0176836 | A1 * | 8/2007 | Abramov | H01Q 1/2291 343/702 |
| 2008/0198060 | A1 * | 8/2008 | Shani | G01S 7/021 342/14 |
| 2010/0301971 | A1 * | 12/2010 | Yonak | H01P 1/20381 333/219.1 |

OTHER PUBLICATIONS

Bingham, et al., "Planar wallpaper group metamaterials for novel terahertz applications," Optics Express, vol. 16, No. 23, pp. 18565-18575, Oct. 27, 2008.

(Continued)

*Primary Examiner* — Dameon E Levi
*Assistant Examiner* — Hasan Z Islam
(74) *Attorney, Agent, or Firm* — Sunstein Kann Murphy & Timbers LLP

(57) ABSTRACT

A reduced radar cross section (RCS) antenna does not require housing the antennas in a radar-mitigating radome. Elements of the antenna are made from, or include, frequency selective surfaces that reduce reflection of radar or other signals. In some embodiments, the frequency selective surfaces are electrically tunable, thereby enabling a user or system to dynamically adjust the frequency or frequencies that are mitigated.

24 Claims, 11 Drawing Sheets

(56) References Cited

OTHER PUBLICATIONS

Bober, et al., "Tailoring the Microwave Permittivity and Permeability of Composite Materials," International Journal of Infrared and Millimeter Waves, vol. 18, No. 1, pp. 101-123, Jan. 1997.
Bunting, et al., "Properties of Barium-Strontium Titanate Dielectrics," Journal of Research of the National Bureau of Standards, Research Paper RP1776, vol. 38, pp. 337-349, Mar. 1947.
Costa, et al., "An Active High Impedance Surface for Low Profile Tunable and Steerable Antennas," IEEE Antennas and Wireless Propagation Letters, vol. 7, 4 pages, 2008.
Cure, et al., "One dimensional capacitive loading in a frequency selective surface for low profile antenna applications," NASA Glenn Research Center (Grant # NNX10AL41H), Raytheon Systems, The National Science Foundation (Grant # ECS-0901779), 4 pages, 2011.
Haghzadeh, et al., "Printed Tunable Miniaturized Metamaterials with BST/Polymer Composite Varactors," International Microelectronics Assembly and Packaging Society (iMaps) Conference, 1 page, May 5, 2015.
Haghzadeh, et al., "Printable Interdigitated Ferroelectric Varactors for Reconfigurable Antennas," Progress in Electromagnetics Research Symposium Abstracts, p. 348, Jul. 2015.
IDTechEx, "IDTechEx Printed Electronics USA 2015 Award Winners," pp. 1, 3, and 4 of 8, Nov. 20, 2015.
Kong, et al., "A novel tunable frequency selective surface absorber with dual-DOF for broadband applications," Optics Express, vol. 22, No. 24, pp. 30217-30224, Nov. 25, 2014.
Li, et al., "A Reflectarray Antenna Backed on FSS for Low RCS and High Radiation Performances," Progress in Electromagnetics Research C, vol. 15, pp. 145-155, 2010.
Manavalan, "Structural and electrical properties of barium strontium titanate thin films for tunable microwave applications," University of South Florida Scholar Commons, 89 pages, 2005.
Mishra, et al., "Tuning of Microstrip Antenna on Ferrite Substrate," IEEE Transactions on Antennas and Propagation, vol. 41, No. 2, pp. 230-233, Feb. 1993.
Naqui, et al., "Novel Sensors Based on the Symmetry Properties of Split Ring Resonators (SRRs)," Sensors, vol. 11, pp. 7545-7553, Jul. 29, 2011.
Safari, et al., "X-Band Tunable Frequency Selective Surface Using MEMS Capacitive Loads," IEEE Transactions on Antennas and Propagation, vol. 63, No. 3, pp. 1014-1021, Mar. 2015.
Sankaralingam, et al., "Development of Textile Antennas for Body Wearable Applications and Investigations on Their Performance Under Bent Conditions," Progress in Electromagnetics Research B, vol. 22, pp. 53-71, 2010.
Sazegar, et al., "Beam Steering Transmitarray Using Tunable Frequency Selective Surface With Integrated Ferroelectric Varactors," IEEE Transactions on Antennas and Propagation, vol. 60, No. 12, pp. 5690-5699, Dec. 2012.
Tian, et al., "Analysis of the RCS and Radiation Pattern of a Planar Array Antenna Integrated with Dielectric and FSS," Progress in Electromagnetics Research Symposium Proceedings, pp. 853-856, Mar. 2010.
Varadan, et al., "Conformal fractal antenna and FSS for low-RCS applications," Smart Structures and Materials 2000: Smart Electronics and MEMS, vol. 3990, abstract only, 2 pages, Mar. 6, 2000.
Wang, et al., "RCS Reduction of Array Antenna by Using Bandstop FSS Reflector," Journal of Electromagnetic Waves and Applications, vol. 23, No. 11-12, abstract only, 3 pages, 2009.
Yang, et al., "Broadband RCS Reduction of Microstrip Patch Antenna Using Bandstop Frequency Selective Surface," Radioengineering, vol. 22, No. 4, pp. 1275-1280, Dec. 2013.
Zhang, et al., "A Quasi-hexagon Shaped Band-stop FSS in Wideband RCS Reduction," PIERS Proceedings, pp. 990-993, Aug. 2014.
Wikipedia, "Frequency selective surface," https://en.wikipedia.org/w/index.php?title=Frequency_selective_surface&oldid=63754535, 13 pages, Dec. 10, 2014.
Wikipedia, "Radar cross-section," https://en.wikipedia.org/w/index.php?title=Radar_cross-section&oldid=636841387, 10 pages, Dec. 6, 2014.
Wikipedia, "Split-ring resonator," https://en.wikipedia.org/w/index.php?title=Split-ring_resonator&oldid=632302014, 4 pages, Nov. 3, 2014.
Wikipedia, "Strontium titanate," https://en.wikipedia.org/w/index.php?title=Strontium_titanate&oldid=627816917, 6 pages, Oct. 1, 2014.
Wikipedia, "Tunable metamaterial," https://en.wikipedia.org/w/index.php?title=Tunable_metamaterial&oldid=638279215, 6.

* cited by examiner

FREQUENCY SELECTIVE SURFACE ANTENNA ELEMENT

CROSS-REFERENCE TO RELATED APPLICATIONS

This application is a continuation of U.S. patent application Ser. No. 14/870,869, filed Sep. 30, 2015, titled "Low-Profile Loop Antenna," which claims the benefit of U.S. Provisional Patent Application No. 62/095,125, filed Dec. 22, 2014, titled "Antenna Designs," the entire contents of each of which are hereby incorporated by reference herein, for all purposes.

TECHNICAL FIELD

The present invention relates to antennas and, more particularly, to antennas that include frequency selective surfaces (FSS) in their radiating and/or parasitic elements to frequency-selectively prevent reflection of received signals, thereby reducing radar cross section (RCS) of the antennas.

BACKGROUND ART

A radar cross section (RCS) of an object is a measure of how visible the object is to radar, i.e., to what extent a radar signal is reflected by the object back toward a radar system. Low RCSs are desirable in many military contexts, such as stealth aircraft. Antennas, such as those used for communication, location finding (beacons) and radar systems, conventionally include metal elements, which have high RCSs.

Every antenna has one or more driven elements, i.e., elements that are directly connected to one or more feedlines. Some antennas also have one or more parasitic elements, i.e., elements that are not directly connected to feedlines, but that are coupled to the driven element(s) only by electric and magnetic fields. Parasitic elements include reflectors and directors. Conventional metal elements reflect radar signals. Thus, these elements have relatively large RCSs, making them vulnerable to detection by enemy radars.

Conventionally, the RCS of an antenna may be reduced by housing the antenna within a radome embedded with frequency selective surfaces (FSS). The FSSs are designed to pass electromagnetic radio frequency (RF) signals radiated by the antenna and signals intended to be received by the antenna, but the FSSs are designed to absorb, or at least reduce reflection of, signals from an enemy radar system. Multiple layers of FSS may be used in the radome to mitigate radar signals at multiple frequencies.

Such radomes are, however, large, massive and difficult to design. Such radomes detune the antennas housed within them, thereby often requiring matching networks at inputs of the antennas or redesigns of the antennas. Furthermore, such radomes alter radiation patterns of the antennas housed within them. Thus, radomes and the antennas they house often need to be co-designed to achieve desired characteristics of both the radomes and the antennas. Frequently, many iterations are required in the co-design process for an antenna and its radome. Furthermore, if an antenna is replaced with an antenna of a different design, its radome may also need to be replaced. Consequently, designing, building and maintaining these radomes and antennas to be housed within them is expensive, complex and time-consuming.

SUMMARY OF EMBODIMENTS

An embodiment of the present invention provides a reduced radar cross section antenna. The antenna has an operating frequency and a radar evasion frequency. The antenna includes at least one driven element. Each driven element of the at least one driven element is sized in accordance with the operating frequency. Each driven element includes a respective frequency selective surface (FSS). The FSS has a resonant frequency equal to the radar evasion frequency, ±30%.

The radar evasion frequency may be at least one order of magnitude greater than the operating frequency.

The radar evasion frequency may be greater than 2 GHz, and the operating frequency may be between 10 MHz and 2 GHz.

Each driven element of the at least one driven element may have a radar cross section, at the radar evasion frequency, at least 20 dB below the radar cross section, at the radar evasion frequency, of a hypothetical solid copper driven element having dimensions equal to corresponding dimensions of one driven element of the at least one driven element.

The radar evasion frequency may be electrically adjustable.

Each frequency selective surface may include a respective plurality of resonators. Each resonator of the plurality of respective resonators may have a resonant frequency equal to the radar evasion frequency, ±30%.

Each resonator of the plurality of resonators may include an electrically tunable dielectric material.

The electrically tunable dielectric material may include barium strontium titanate.

The electrically tunable dielectric material may have a dielectric constant. The resonant frequency of each resonator of the plurality of resonators may depend on the dielectric constant. The dielectric constant may be electrically adjustable.

The dielectric constant may vary according to a temperature of the dielectric material. The antenna may further include an electrically adjustable heater thermally coupled to the dielectric material.

The dielectric constant may vary according to a bias voltage applied to the dielectric material. The antenna may further include a first bias electrode disposed proximate the dielectric material.

The reduced radar cross section antenna may further include a second bias electrode disposed proximate the dielectric material. The dielectric material may be disposed between the first bias electrode and the second bias electrode.

Each frequency selective surface may include a respective plurality of resonators. Each resonator of the respective plurality of resonators may have a resonant frequency equal to the radar evasion frequency, ±30%.

Each resonator of each plurality of resonators may include a substantially rectangular electrically conductive loop. The antenna may further include a dielectric substrate. For each driven element of the at least one driven element, the driven element may have a respective longitudinal axis. The plurality of resonators of the driven element may be arranged in a one-dimensional array on the dielectric substrate. The plurality of resonators of the driven element may be arranged along the longitudinal axis of the driven element.

The dielectric substrate may be sufficiently flexible to be formed into a 3-inch (7.6-cm) diameter loop by an unaided human hand.

Each driven element of the at least one driven element may include a first bias terminal. Each driven element of the at least one driven element may also include a first elongated electrically conductive member electrically coupled to the first bias terminal. Each driven element of the at least one driven element may also include a second bias terminal. Each driven element of the at least one driven element may also include a second elongated electrically conductive member electrically coupled to the second bias terminal and disposed parallel to, and spaced apart from, the first elongated electrically conductive member.

The first and second elongated electrically conductive members may define respective counterfacing sides. Each counterfacing side may define a respective plurality of recesses along a length of the counterfacing side. Each recess defined by the first elongated electrically conductive member may register, normal to the counterfacing sides, with a corresponding recess defined by the second elongated electrically conductive member. Thus, a plurality of counterfacing recess pairs may be formed.

For each counterfacing recess pair of the plurality of counterfacing recess pairs, the antenna may also include a respective dielectric material disposed therein. The first and second elongated electrically conductive members and the dielectric material may collectively define the frequency selective surface.

Each counterfacing recess pair of the plurality of counterfacing recess pairs and the respective dielectric material disposed therein may include a respective resonator having a resonant frequency equal to the radar evasion frequency, ±30%.

A dielectric constant of the respective dielectric material disposed in each counterfacing recess pair of the plurality of counterfacing recess pairs may be electrically tunable. The dielectric constant may be tunable according to a bias voltage applied across the first and second bias terminals.

The respective dielectric material disposed in each counterfacing recess pair of the plurality of counterfacing recess pairs may include barium strontium titanate.

Each driven element of the at least one driven element may include an elongated electrically conductive member defining a plurality of apertures. Each aperture of the plurality of apertures may be sized according to the radar evasion frequency.

BRIEF DESCRIPTION OF THE SEVERAL VIEWS OF THE DRAWING

Embodiments of the invention will be more fully understood by referring to the following Detailed Description of Specific Embodiments in conjunction with the Drawings, of which.

DETAILED DESCRIPTION OF SPECIFIC EMBODIMENTS

In accordance with embodiments of the present invention, methods and apparatus are disclosed for constructing and operating reduced radar cross section (RCS) antennas. These antennas have RCSs much lower than conventional antennas, without housing the antennas in radar-mitigating radomes or the like. Elements of the antennas according to embodiments of the present invention are made from, or include, frequency selective surfaces that reduce reflection of radar or other signals. In some embodiments, the frequency selective surfaces are electrically tunable, thereby enabling a user or system to dynamically adjust the frequency or frequencies that are mitigated.

The prior art teaches antennas with antenna elements backed by frequency selective surfaces, i.e., the frequency selective surfaces are behind the antenna elements, in some cases spaced apart from the antenna elements. However, antenna elements according to the present invention are themselves made of, or patterned to act as, frequency selective surfaces. The frequency selective surfaces are not structures separate from the antenna elements.

Both driven antenna elements and parasitic antenna elements may be made according to teachings of the present disclosure. The antenna elements may be arranged in any suitable antenna configuration, such as a monopole antenna, a dipole antenna or a Yagi-Uda ("Yagi") antenna, as well as in an antenna array.

Figure 1:
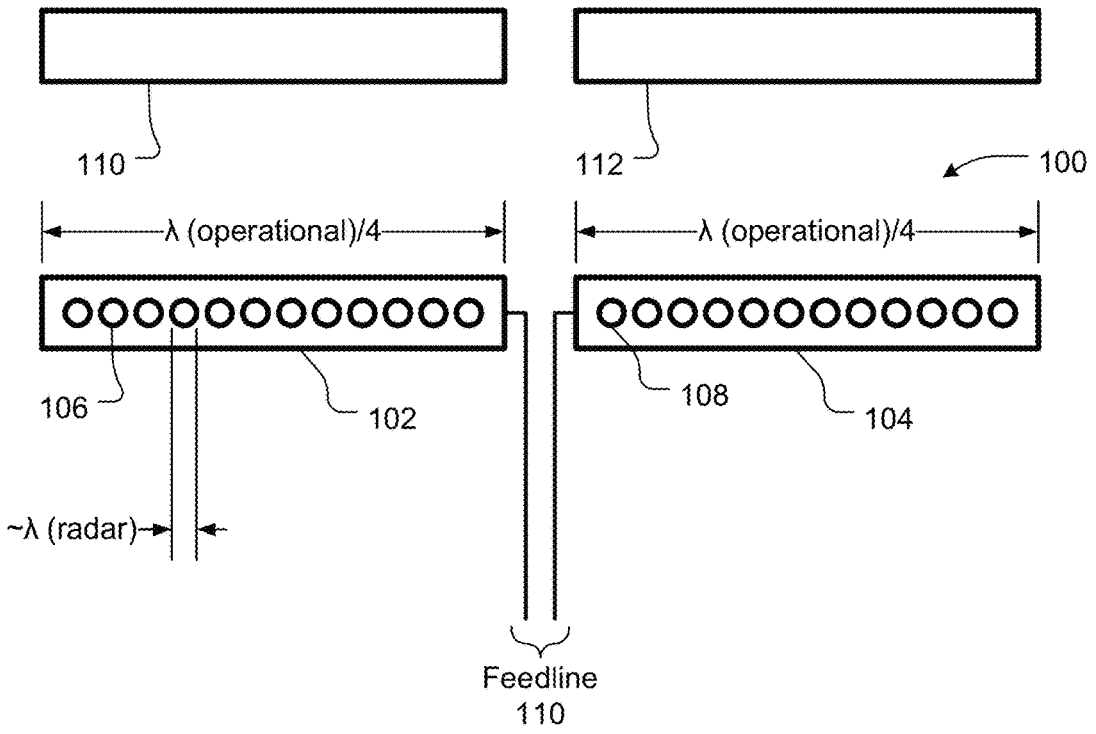
FIGS. 1, 2 and 3 are schematic diagrams of respective exemplary dipole, monopole and helical antennas having driven elements made of frequency selective surfaces, according to embodiments of the present invention.

For example, FIG. 1 is a schematic diagram of an exemplary half-wavelength dipole antenna 100 having two quarter-wavelength driven elements 102 and 104, according to an embodiment of the present invention. The antenna 100 is fed by a feedline 110. The antenna 100 may be used for receiving and/or transmitting signals. For example, the antenna 100 may be coupled via the feedline 110 to a transmitter, a receiver or a transceiver (not shown). The antenna 100 may, for example, be coupled to a communications transceiver (not shown) or a radar system (not shown).

In general, antenna element sizes are selected according to wavelengths (equivalently frequencies) of electromagnetic radio frequency (RF) signals on which the antennas are designed to operate, i.e., send and/or receive the RF signals. This frequency, a range of such frequencies or a representative frequency in the frequency range is referred to herein as an "operating frequency."

When referring to a "size" of something, such as an antenna element or a resonator, in relation to wavelength (equivalently frequency), the size herein typically refers to the largest dimension of the thing, although in some cases antenna element size may refer to another dimension of the antenna element. Furthermore, size, in relation to wavelength (equivalently frequency), refers to electrical length, taking into account the velocity factor of the material of the thing. Velocity factor is the speed at which an RF signal travels in the thing, typically stated as a fraction of the speed of light in a vacuum.

Although quarter-wavelength ("λ(operational)/4") driven elements 102 and 104 are shown, the lengths of antenna elements 102 and 104 can be other fractions of the wavelength at the operating frequency, as is well known in the art, without departing from the scope of the invention. Furthermore, both elements 102 and 104 need not be of equal lengths.

Each element 102 and 104 includes a frequency selective surface, which includes or defines a plurality of resonators, represented by resonators 106 and 108. The frequency selective surface may be made of a metamaterial. The resonators 106-108 are sized according to wavelengths (equivalently frequencies), or ranges thereof of, or a representative frequency in the frequency range, of expected radar or other RF signals, whose reflections off the elements 102 and 104 should be reduced. The term "radar evasion frequency" is used herein to refer to the frequency, range of frequencies or a representative frequency in the frequency range of one or more signals, whose reflections off the elements are to be reduced. Typically, the radar evasion frequency is at least two orders of magnitude greater than the operating frequency. In some embodiments, each of the resonators 106-108 is on the order of one wavelength long, ±30%, at the radar evasion frequency.

Figure 2:
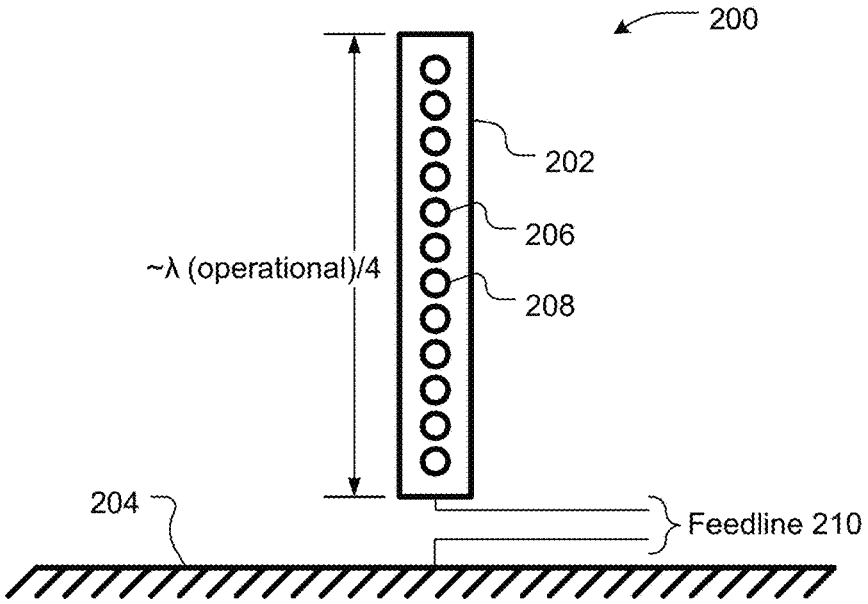

FIG. 2 is a schematic diagram of another type of antenna that may be made, according to an embodiment of the present invention. FIG. 2 shows a quarter-wavelength monopole antenna 200 having a vertical driven element 202 and a ground plane 204. As with the antenna 100 of FIG. 1, although a quarter-wavelength driven elements 202 is shown, other fractions of wavelengths may be used.

The driven element 202 includes a frequency selective surface, including a plurality of resonators, represented by resonators 206 and 208. The resonators 206-208 are sized according to the radar evasion frequency, as discussed with respect to the dipole antenna 100 of FIG. 1. The monopole antenna 200 may be coupled via a feedline 210 to a transmitter, a receiver or a transceiver (not shown).

Figure 3:
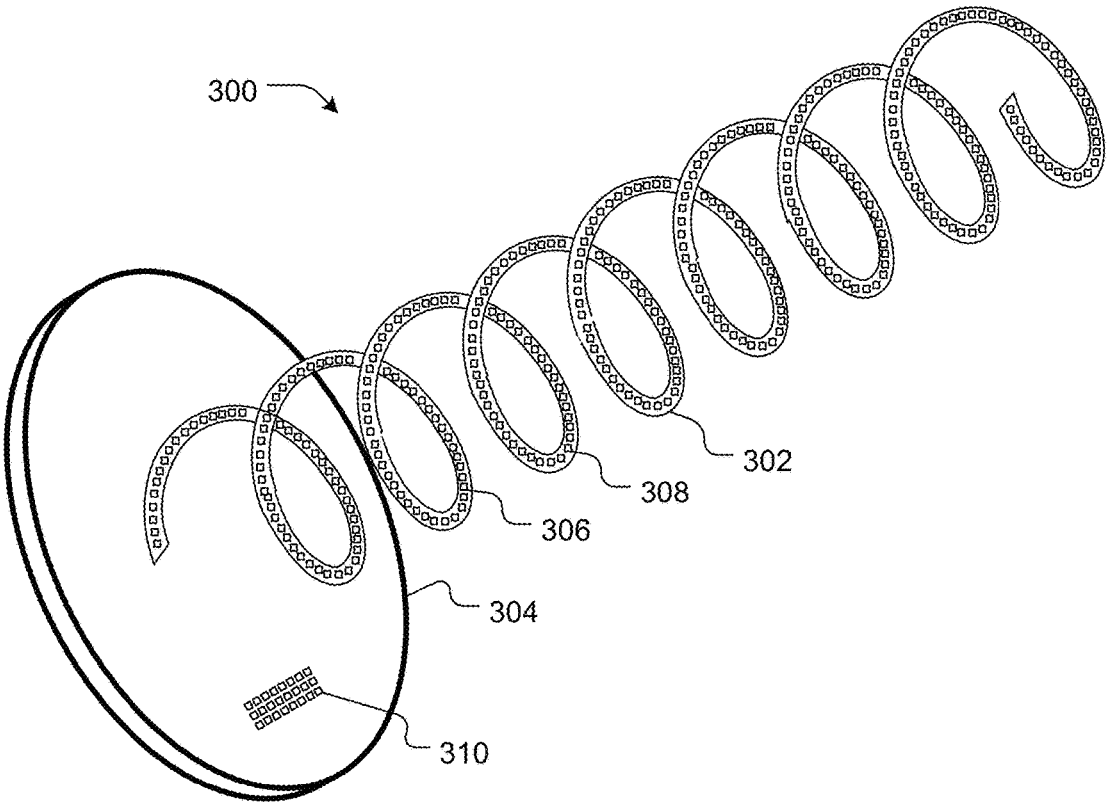

FIG. 3 is a schematic diagram of yet another type of antenna that may be made, according to an embodiment of the present invention. FIG. 3 shows a helical antenna 300 having a helical driven element 302 and an optional ground plane 304. The driven element 302 includes a frequency selective surface, including a plurality of resonators, represented by resonators 306 and 308. The resonators 306-308 are sized according to the radar evasion frequency, as discussed with respect to the dipole antenna 100 of FIG. 1. Optionally, the ground plane 304 may include a frequency selective surface, a portion of which is shown at 310.

The dipole antenna 100 of FIG. 1, the monopole antenna 200 of FIG. 2 and the helical antenna 300 of FIG. 3 are only three examples of antennas that may be made, according to embodiments of the present invention. Other examples include, without limitation, patch antennas, loop antennas, Yagi antennas and planar spiral antennas (not shown.) Furthermore, other antenna elements, such as reflectors and directors, may include frequency selective surfaces to reduce their RCS. However, all elements of an antenna need not be of equal physical or electrical lengths. For example, in a Yagi antenna, the reflector element is typically slightly longer than the driven dipole element, and the director elements are a little shorter than the driven dipole element.

Frequency Selective Surfaces

Figure 4:
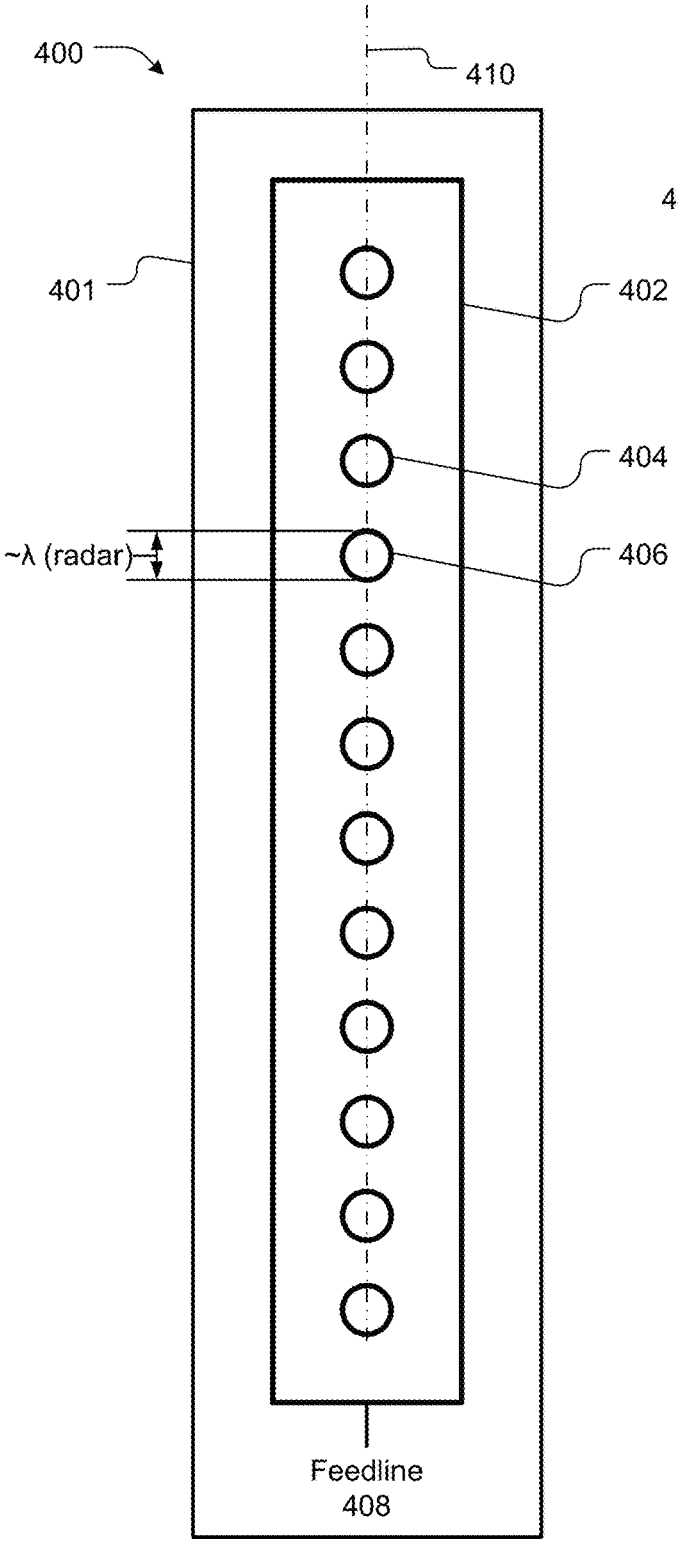
FIGS. 4 and 5 are respective schematic top (plan) and side (elevation) views of an antenna element made of a frequency selective surface, according to an embodiment of the present invention.
Figure 5:
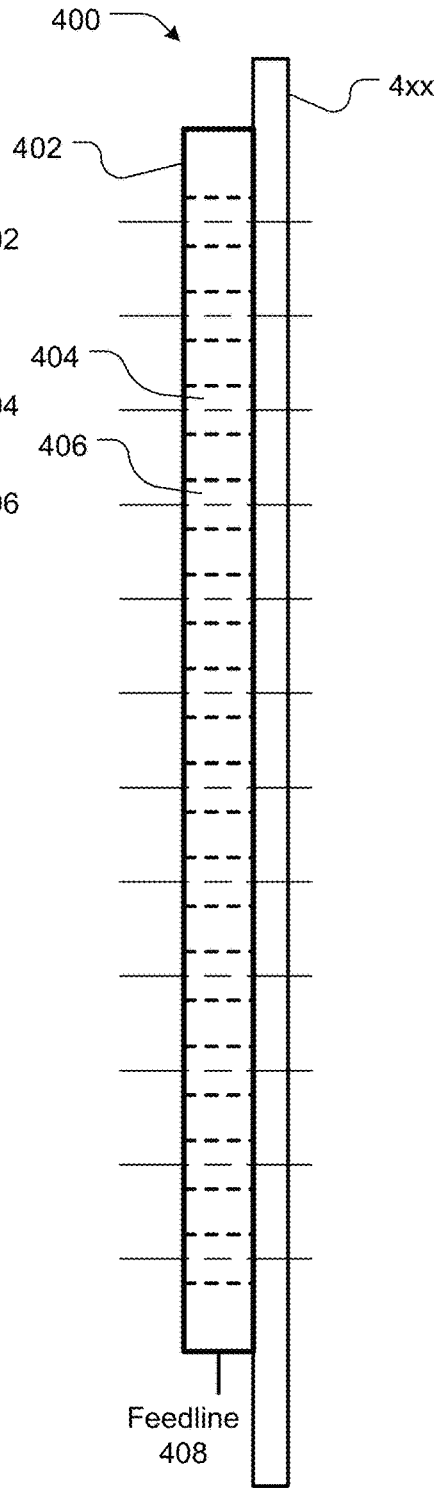

Any suitable frequency selective surface may be used for or in the antenna elements. FIGS. 4 and 5 are respective schematic top (plan) and side (elevation) views of an antenna element 400, according to an embodiment of the present invention. Each of the driven elements 102 and 104 of the antenna 100 discussed with respect to FIG. 1 may, for example, be implemented by the antenna element 400. Similarly, driven and/or parasitic elements in other antenna configurations may be implemented by the antenna element 400.

The antenna element 400 includes an electrically conductive member 402, such as a metal member, such as a copper or other suitable metal strip. Optionally, the antenna element 400 may include a suitable dielectric substrate 401, such as a polyimide film. Such a film is available from E. I. du Pont de Nemours and Company under the tradename Kapton. The electrically conductive member 402 may be attached to a surface of the substrate 401. Alternatively, the electrically conductive member 402 may be disposed partially or completely within the thickness of the substrate 401.

If the antenna element 400 is a driven element, a feedline 408 may be electrically coupled to the element 400. An impedance matching network (not shown) may be interposed between the feedline 408 and the antenna element 400.

The electrically conductive member 402 is perforated to define a plurality of apertures, represented by apertures 404 and 406. The apertures 404-406 form resonators. The resonators 406-408 are sized according to the radar evasion frequency. In the embodiment of FIGS. 4 and 5, the apertures are one wavelength in diameter ("λ(radar)"), ±30%, at the radar evasion frequency. In the embodiment of FIGS. 4 and 5, the resonators 406-408 are arranged in a one-dimensional array oriented along a longitudinal axis 410 of the antenna element 400. However, in other embodiments, the resonators 406-408 may be arranged in two-dimensional arrays or in other patterns or randomly. Similarly, the resonators 406-408 may be disposed parallel to, not necessarily on, the longitudinal axis 410, or along another axis (not shown) of the antenna element 400 or not along any particular axis.

A fraction of the surface area of the electrically conductive member 402 is perforated. The fraction may be selected based on considerations, such as a desired amount of reflection reduction of the radar evasion frequency, an extent to which the perforations mechanically weaken the electrically conductive member 402 and cost of perforating the electrically conductive member 402. Although round apertures 404-406 are shown, other shaped apertures, such as rectangles, including mixtures of shapes on a single antenna element, may be used. Various antenna elements of a single antenna may have different numbers of apertures, differently sized apertures and/or differently shaped apertures.

Figure 6:
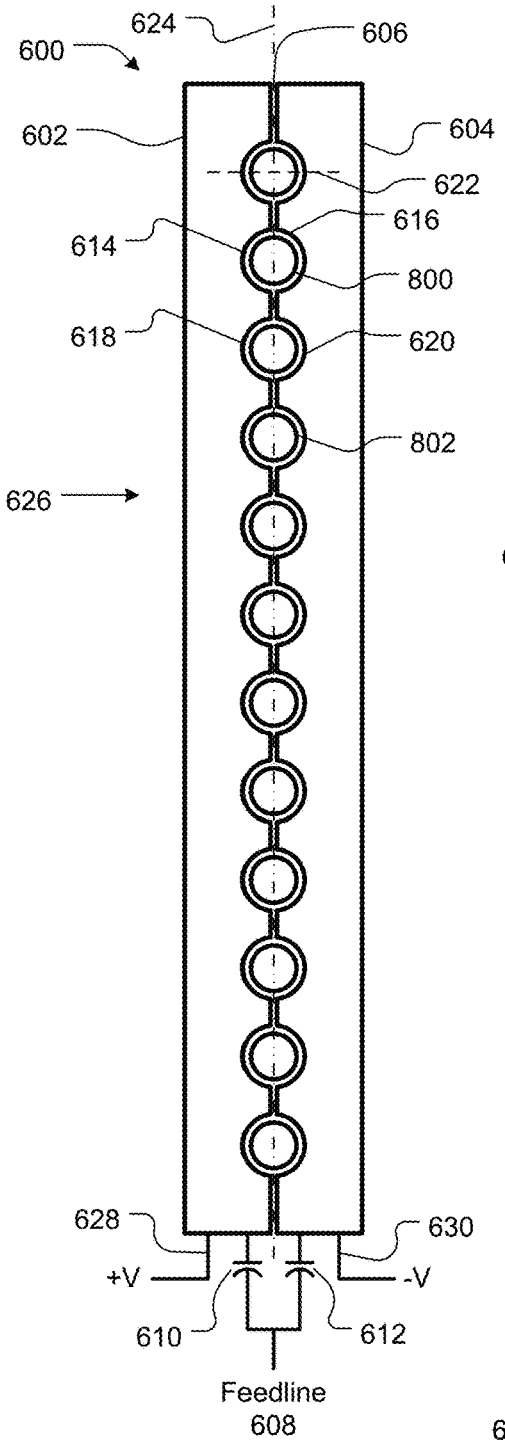
FIG. 6 is a top (plan) schematic view of an antenna element made of a frequency selective surface, according to another embodiment of the present invention.

FIG. 6 is a top (plan) schematic view of an antenna element 600, according to another embodiment of the present invention. Each of the driven elements 102 and 104 of the antenna 100 discussed with respect to FIG. 1 may, for example, be implemented by the antenna element 600. Similarly, driven and/or parasitic elements in other antenna configurations may be implemented by the antenna element 600.

The antenna element 600 includes two parallel, spaced-apart elongated electrically conductive members 602 and 604, such as metal members, such as copper strips. The two electrically conductive members 602 and 604 are DC electrically isolated from each other by a gap 606. The gap 606 may be empty or it may be filled with air or another suitable dielectric material.

If the antenna element 600 is a driven element, a feedline 608 may be electrically coupled to the antenna element 600. Capacitors 610 and 612 may be used to electrically couple the feedline 608 to the two electrically conductive members 602 and 604 while maintaining DC isolation between the electrically conductive members 602 and 604. Values of the capacitors 610-612 may be selected based on the operating frequency. An impedance matching network (not shown) may be interposed between the feedline 608 and the antenna element 400.

Figure 7:
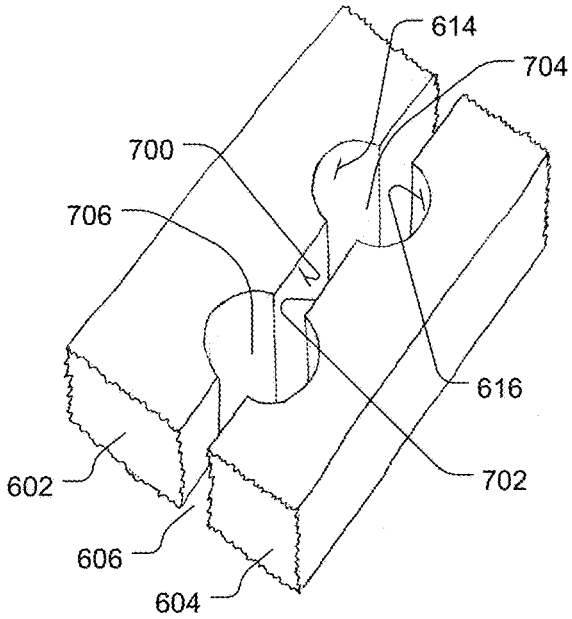
FIGS. 7 and 8 are enlarged views of a portion of the antenna element of FIG. 6, respectively without and with a dielectric material installed therein.

The two spaced-apart electrically conductive members 602 and 604 define respective counterfacing sides 700 and 702, as shown in FIG. 7, which is an enlarged perspective schematic view of a portion of the electrically conductive members 602 and 604. Each counterfacing side 700 and 702 defines a respective plurality of recesses, represented by recesses 614, 616, 618 and 620, along a length of the respective counterfacing side 700 or 702. For example, counterfacing side 700 defines recesses 614 and 618, and counterfacing side 702 defines recesses 616 and 620.

Each recess 614 and 618 defined by the first elongated electrically conductive member 602 registers with a corresponding recess 618 and 620 defined by the second elongated electrically conductive member 604. The registration is normal to the counterfacing sides 700 and 702, as represented by a line 622, which is perpendicular (normal) to a longitudinal axis 624 of the antenna element 600. The recesses 614-620 form a plurality of counterfacing recess pairs, represented by recess pairs (614, 616) and (618, 620). Each counterfacing recess pair (614, 616)-(618, 620) defines a respective space therebetween, represented by spaces 704 and 706.

Figure 8:
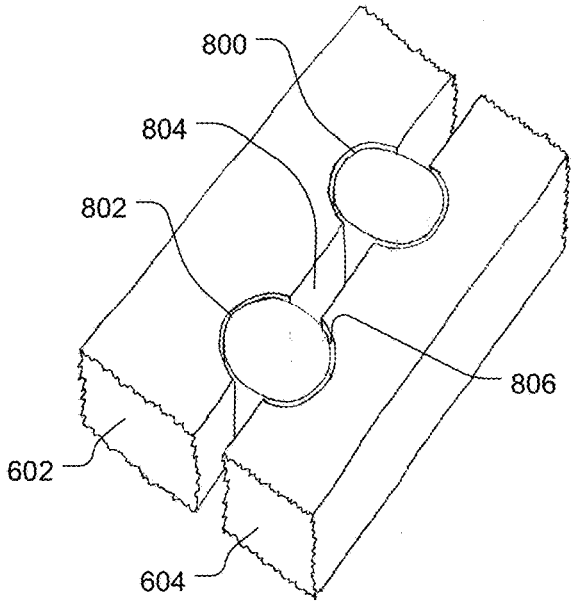

A respective portion of a suitable dielectric material, represented by dielectric material portions 800 and 802, is disposed in each space 704-706, as shown in FIG. 8, which is a perspective view of the same portion of the electrically conductive members 602 and 604 as shown in FIG. 7. Each counterfacing recess pair (614, 616)-(618, 620) and the corresponding portion 800 and 802 of the dielectric material define a respective resonator having a resonant frequency equal to the radar evasion frequency, ±30%. The first and second electrically conductive members 602 and 604 and the portions of the dielectric material 800-802 collectively define a frequency selective surface 626.

As discussed with respect to the antennal element 400 (FIG. 4), the antenna element 600 may include a suitable dielectric substrate (not included in FIGS. 6-8 for clarity). The electrically conductive members 602 and 604 may be attached to a surface of the substrate, or the electrically conductive members 602 and 604 may be disposed partially or completely within the thickness of the substrate. The portions 800-802 of the dielectric material may be integral with or attached to the substrate.

Although the portions 800-802 of the dielectric material are shown as being cylindrical in shape, the portions 800-802 of the dielectric material may be any shape. Although the portions 800-802 of the dielectric material are shown as distinct portions, they may be coupled together by, or attached to, a common portion of the dielectric material. For example, each of the cylindrical portions may extend upward from a common substrate (not shown). Similarly, although a void 804 is shown between adjacent pairs of the portions 800 and 802 of the dielectric material, the void 804 may be filled with dielectric material. For clarity, the portions 800-802 of the dielectric material are shown spaced apart from the counterfacing recesses 614-620, such as by a gap 806. However, the portions 800-802 of the dielectric material may be in intimate contact with the counterfacing recesses 614-620.

In some embodiments all the recesses 614-620 are of equal sizes, in which case all the resonators have identical or nearly identical resonant frequencies, so the frequency selective surface 626 mitigates a single radar frequency. However, in other embodiments some of the recesses 614-620 are of different sizes from other of the recesses 614-620, in which case some of the resonators have different resonant frequencies from other of the resonators, so the frequency selective surface 626 mitigates a plurality of radar frequencies.

Tunable Frequency Selective Surfaces

The dielectric constant of some dielectric materials ("tunable dielectric materials"), such as barium strontium titanate (BST), can be varied by varying a bias voltage across the materials. Thus, capacitance of a capacitor formed with a tunable dielectric material can be varied in real time by varying a bias voltage across the tunable dielectric material.

The two electrically conductive members 602 and 604 are DC isolated from each other and thus form a capacitor, which may be considered to be composed of a plurality of individual capacitors, each individual capacitor being formed by a counterfacing recess pair (614, 616)-(618, 620) and the respective dielectric material 800-802 disposed between the counterfacing recess pair (614, 616)-(618, 620).

A voltage applied across the two electrically conductive members 602 and 604 biases the dielectric material disposed in the spaces 704-706. Each electrically conductive member 602 and 604 is electrically coupled to a respective bias terminal 628 and 630. Thus, varying a voltage applied across the bias terminals 628 and 630 causes the capacitance of the individual capacitors to vary, thereby varying the resonant frequency of the resonators and, consequently, the frequency of the frequency selective surface 626.

Figure 9:
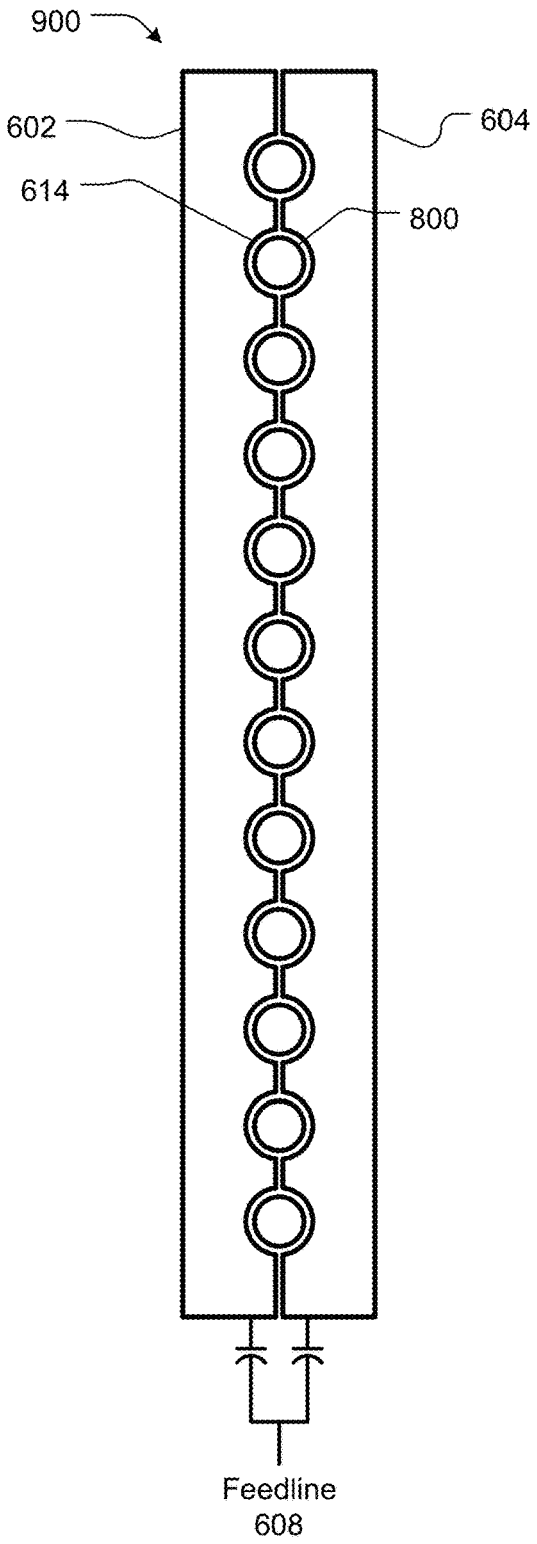
FIGS. 9 and 10 are respective schematic top (plan) and side (elevation) views of an antenna element made of a tunable frequency selective surface, according to an embodiment of the present invention.
Figure 10:
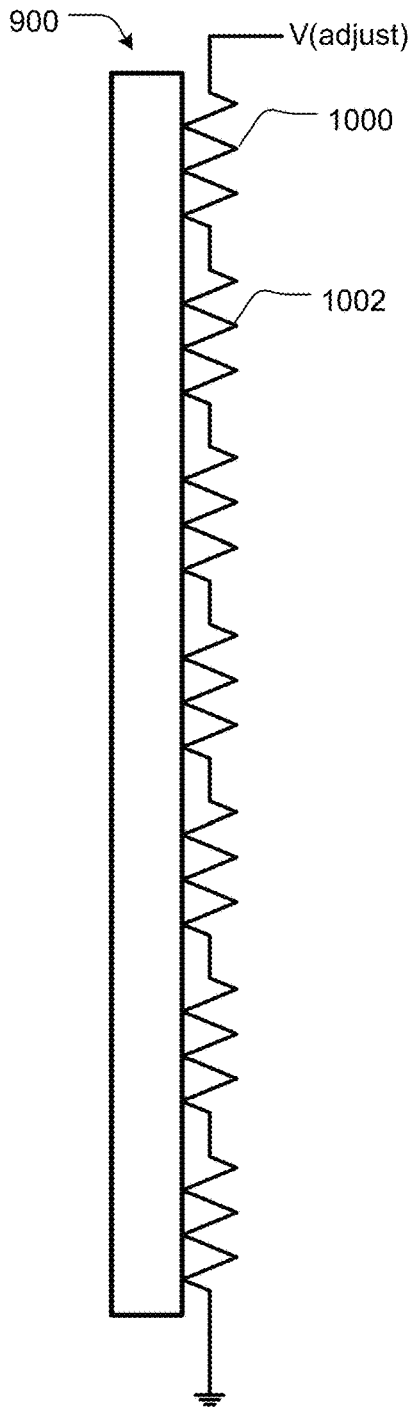

The dielectric constant of some dielectric materials (also referred to as "tunable dielectric materials"), such as transition metal oxides, can be varied by varying the temperature of the materials. In an antenna element 900, according to another embodiment, top (plan) and side (elevation) views of which are schematically provided in FIGS. 9 and 10, respectively, the dielectric constant of the dielectric material is varied by varying temperature of the dielectric material. Instead of bias terminals, the antenna element 900 includes one or more electrical heaters, such as resistors, represented by resistors 1000 and 1002, thermally coupled to the antenna element 900 and fed by an adjustable voltage ("V(adjust)"). Other aspects of the antenna element 900 are similar to those of the antenna element 600 discussed with respect to FIGS. 6-8.

Figures 11, 12, 13, 14:
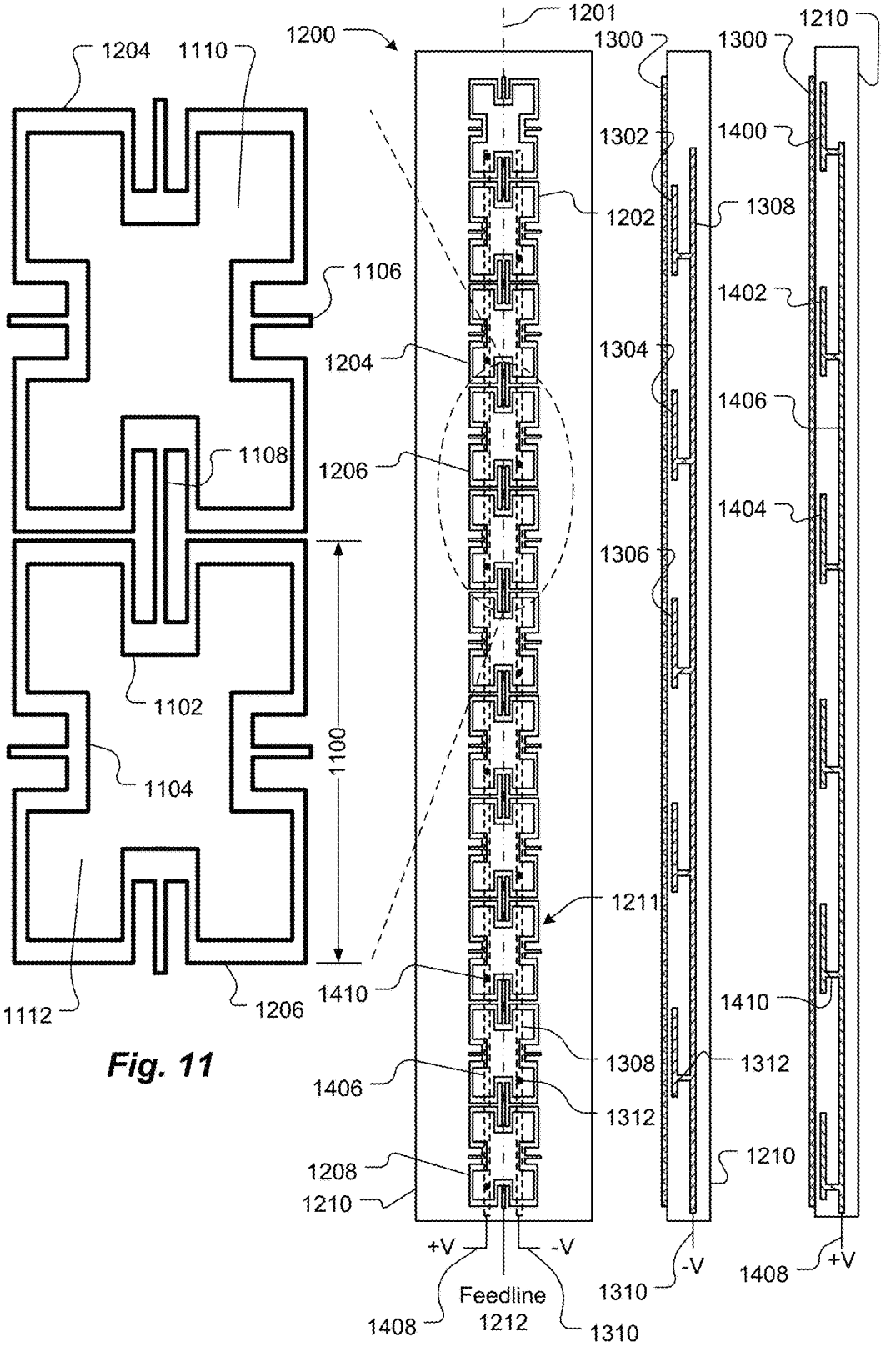
FIG. 12 is a schematic top (plan) view of an antenna element made of a tunable frequency selective surface, according to another embodiment of the present invention.
FIG. 11 is an enlarged view of a portion of the antenna element of FIG. 12.
FIGS. 13 and 14 are side (elevation) cross-sectional views of the antenna element of FIG. 12.

FIGS. 11-14 schematically illustrate an antenna element 1200 according to yet another embodiment of the present invention. FIG. 12 provides a top (plan) view of the antenna element 1200, and FIG. 11 provides an enlarged view of a portion of the top view of the antenna element 1200. FIGS. 13 and 14 provide side (elevation) cross-sectional views of the antenna element 1200.

As indicated in FIG. 12, the antenna element 1200 has a longitudinal axis 1201. The antenna element 1200 includes a plurality of electrically conductive rings, represented by rings 1202, 1204, 1206 and 1208, arranged in a one-dimensional array disposed along the longitudinal axis 1201. The rings 1202-1208 may be made of metal, such as thin copper. The rings 1202-1208 are attached to a surface of a dielectric substrate 1210. Alternatively (not shown), the rings 1202-1208 may be disposed partially or completely within the thickness of the substrate 1210. As used herein, "on the dielectric substrate" means attached to the surface of the dielectric substrate or disposed partially or completely within the thickness of the dielectric substrate. In FIGS. 13 and 14, the rings 1202-1208 are shown attached to the surface of the dielectric substrate 1210.

The rings 1202-1208 and the dielectric substrate 1210 may be flexible, for example so as to be conformable to a surface of another object. In some embodiments, the dielectric substrate is sufficiently flexible to be formed into a 3-inch (7.6-cm) diameter loop by an unaided human hand.

Returning to FIGS. 11 and 12, the rings 1202-1208 are sized in accordance with the wavelength (equivalently frequency) of a signal at the radar evasion frequency. In some embodiments, length 1100 of a long side of each ring 1202-1208 is equal to one wavelength of the radar evasion frequency.

Although the rings 1202-1208 are shown as being substantially rectangular in shape, the rings 1202-1208 can be made in other suitable shapes, including dipoles, tri-poles, rings, circles, squares, coupled lines or transmission line filter structures. "Substantially rectangular" means the overall shape of each ring is rectangular, although, as shown in FIGS. 11-12, the ring perimeter may include deviations from a straight-sided rectangle, such as deviations 1102 and 1104. In addition, each ring 1202-1208 may include additional projections, such as projection 1106. Adjacent rings 1202-1208 are electrically coupled to each other via a thin electrical conductor, represented by electrical conductor 1108, extending between the rings 1202-1208. The electrical conductor 1108 acts as an inductor. Each ring 1202-1208 is a resonator that resonates at the radar evasion frequency, and collectively the rings 1202-1208 form a frequency selective surface 1211.

At least one of the rings, for example the ring 1208, is electrically couple to a feedline 1212. Electric and magnetic fields between adjacent rings 1202-1208 couple adjacent rings to each other to propagate signals at the operational frequency along the antenna element 1200.

As thus far described, the frequency selective surface 1211 is not tunable. However, with addition of a suitable tunable dielectric material and biasing electrodes or heaters, the frequency selective surface 1211 can be made electrically tunable. In a tunable embodiment, at least a portion of the interior, exemplified at 1110 and 1112, of each ring 1202-1208 contains a tunable dielectric material, such as barium strontium titanate. A respective biasing electrode is disposed proximate the dielectric material in each ring 1202-1208. The biasing electrodes can be generally rectangular and sized approximately the same as the rings 1202-1208, or the biasing electrodes may be sized and/or shaped differently from the rings 1202-1208.

FIGS. 13 and 14 show exemplary arrangements of biasing electrodes, exemplified by biasing electrodes 1302, 1304, 1306, 1400, 1402 and 1404. Alternate biasing electrodes 1302-1306 are electrically connected to each other by a biasing bus 1308, which terminates at a biasing terminal 1310. Each biasing electrode 1302-1306 is electrically coupled to the biasing bus 1308 by a respective connecting bar, exemplified by connecting bar 1312. Similarly, remaining biasing electrodes 1400-1404 are electrically connected to each other by a biasing bus 1406, which terminates at a biasing terminal 1408. Each biasing electrode 1400-1404 is electrically coupled to the biasing bus 1406 by a respective connecting bar, exemplified by connecting bar 1410.

Thus, the dielectric material in alternate ones of the rings 1202-1208 may be biased by applying a bias voltage (for example −V) to biasing terminal 1310, and the dielectric material in remaining rings 1202-1208 may be biased by applying a different bias voltage (for example +V) to biasing terminal 1408. Varying the difference between the bias voltages applied to the biasing terminals 1310 and 1408 adjusts the dielectric constant of the dielectric materials in the spaces 1110 and 1112 and, therefore, the resonant frequency of the frequency selective surface 1211.

Simulated Results

Figure 15:
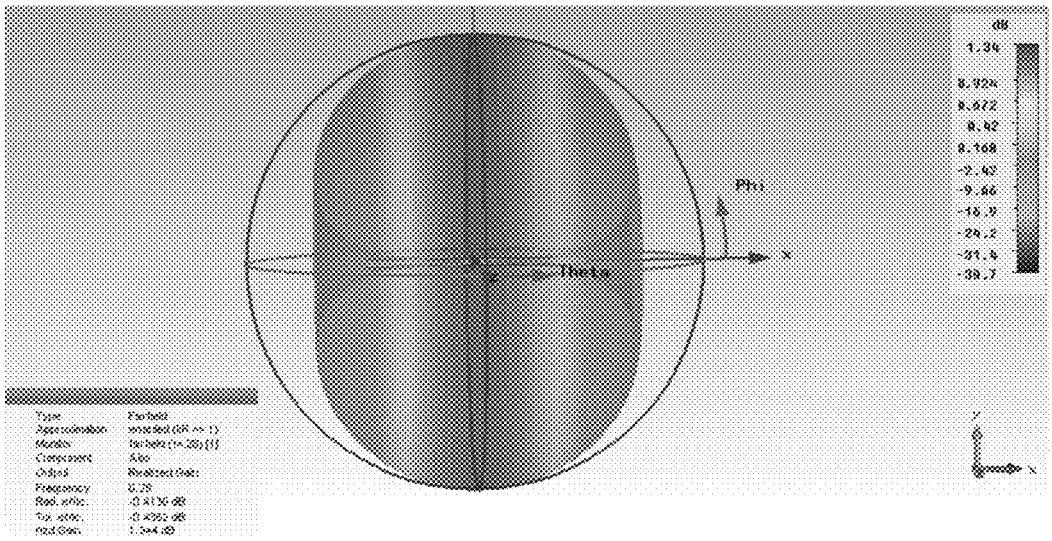
FIG. 15 is a graph illustrating a radiation pattern of a computer-simulated dipole antenna made of two solid metal antenna elements, according to the prior art.
Figure 16:
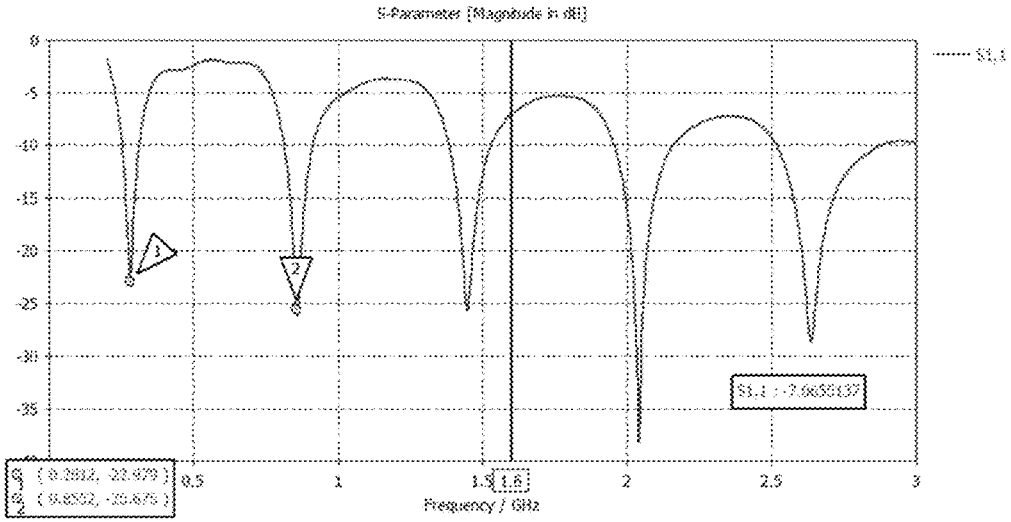
FIG. 16 is a graph of an S11 parameter of the computer-simulated dipole antenna of FIG. 15.

FIG. 15 is a graph illustrating a radiation pattern of a computer-simulated dipole antenna made of two conventional solid metal antenna elements. FIG. 16 is a graph of an S11 parameter of the computer-simulated dipole antenna.

Figure 17:
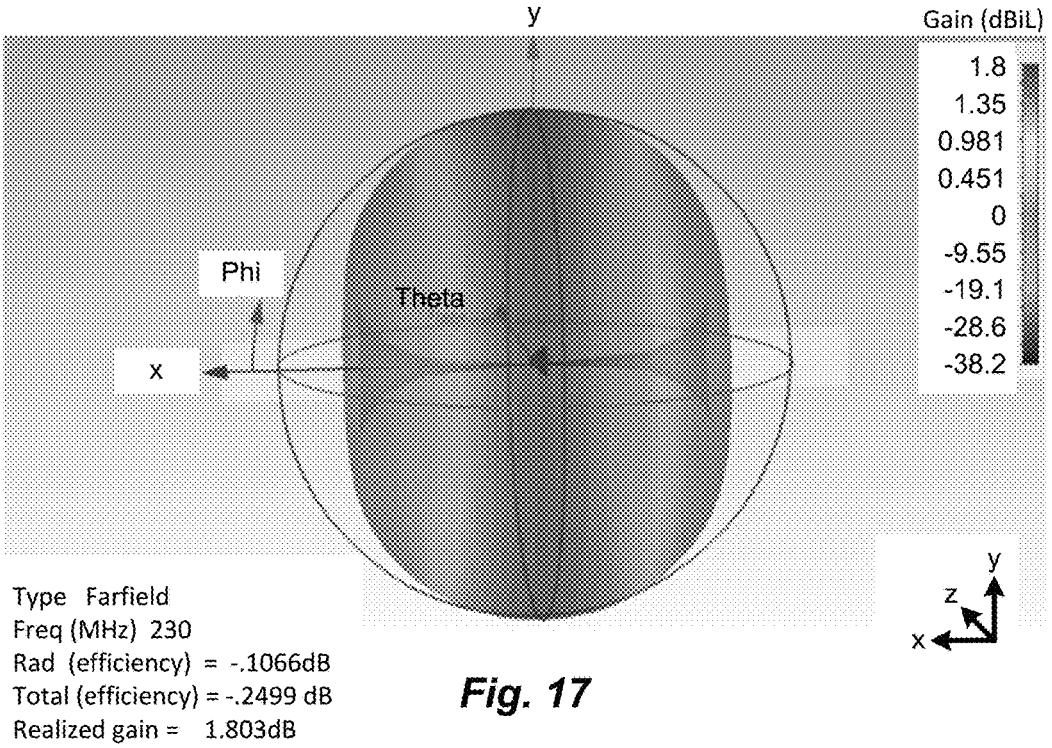
FIG. 17 is a graph illustrating a radiation pattern of a computer-simulated dipole antenna made of two antenna elements according to FIG. 12.
Figure 18:
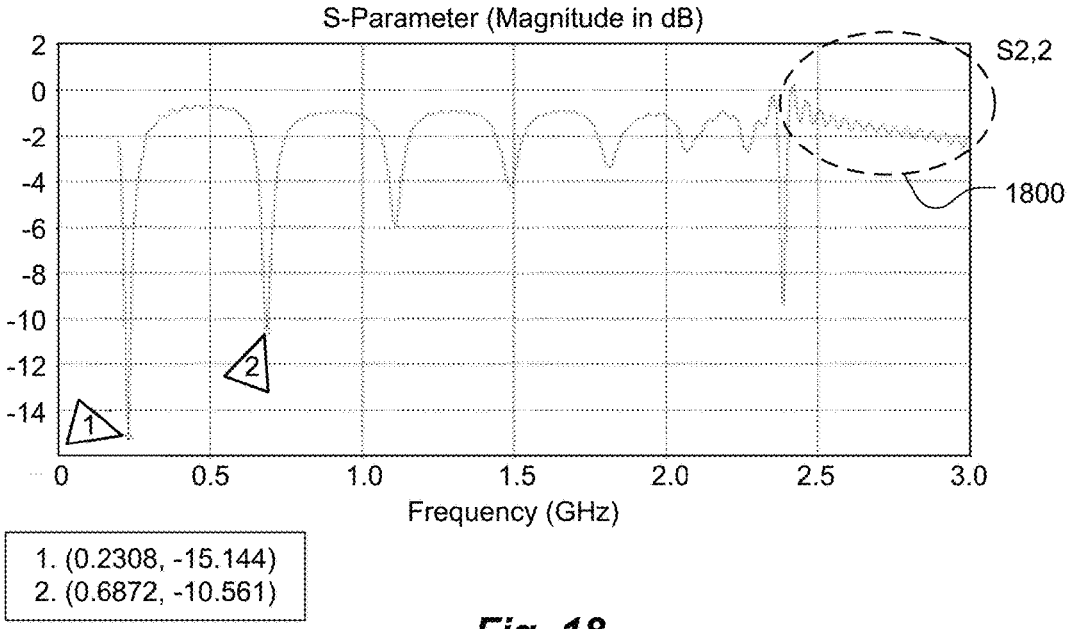
FIG. 18 is a graph of an S11 parameter of the computer-simulated dipole antenna of FIG. 17.

For comparison, FIG. 17 is a graph illustrating a radiation pattern of a computer-simulated dipole antenna made of two antenna elements according to FIG. 12, and FIG. 18 is a graph of an S11 parameter of the computer-simulated dipole antenna. The frequency selective surfaces 1200, particularly the rings 1202-1208 and the dielectric materials in the interiors 1110 and 1112 of the rings, of the antenna simulated in FIGS. 17 and 18 was configured for a radar evasion frequency in a range of 234-280 MHz.

The antenna elements of the antenna simulated in FIGS. 15 and 16 have outer dimensions comparable to outside dimensions of the antenna elements of the antenna simulated in FIGS. 17 and 18. Nevertheless, the antenna made of the frequency selective surfaces has a resonant frequency (2.308 MHz) about 18% lower than the resonant frequency (2.812 MHz) of the solid-element antenna simulated in FIG. 15. Significantly, the antenna made of the frequency selective surfaces exhibits a significant stop band, outlined in FIG. 18 at 1800, in the radar evasion frequency range, whereas the conventional antenna does not exhibit such a stop band. Furthermore, the antenna made of the frequency selective surfaces has somewhat higher gain (1.8 dBiL) than the conventional antenna (1.34 dBil).

Figure 19:
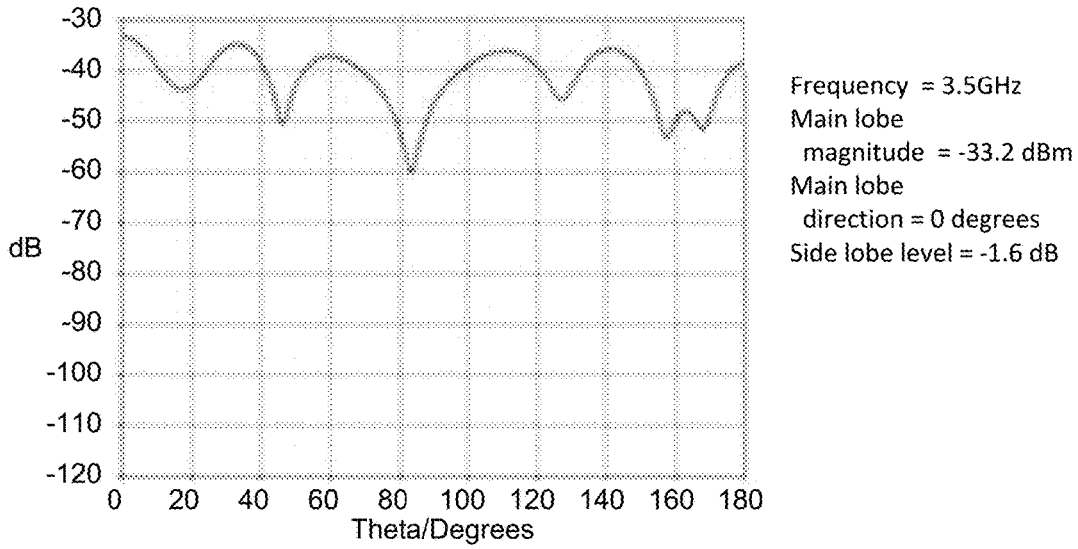
FIG. 19 is a graph of radar cross section (RCS) of a computer-simulated dipole antenna made of two solid metal antenna elements, according to the prior art.
Figure 20:
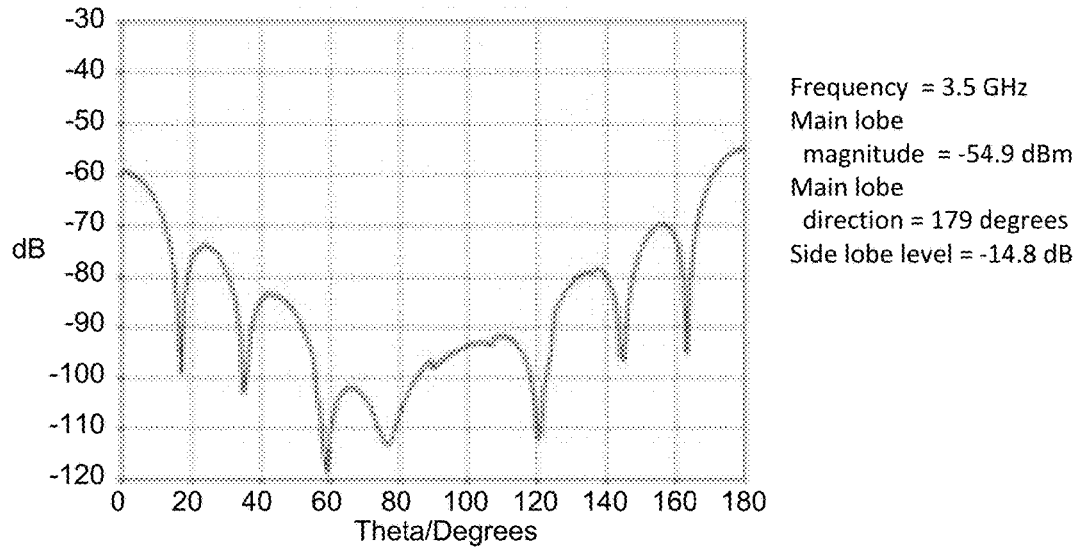
FIG. 20 is a graph of radar cross section (RCS) of a computer-simulated dipole antenna made of two antenna elements according to FIG. 12.

FIG. 19 is a graph of radar cross section (RCS) at 3.5 GHz of a computer-simulated dipole antenna made of two conventional solid metal antenna elements. FIG. 20 is a graph of RCS at the same frequency of a computer-simulated dipole antenna made of two antenna elements of FIG. 12, where the frequency selective surfaces were configured to resonate at 3.5 GHz. The two antennas simulated in FIGS. 19 and 20 have comparable outer dimensions. A comparison of the graphs in FIGS. 19 and 20 shows the antenna made with frequency selective surface elements exhibits about 30 dB less RCS than the conventional antenna. Thus, as shown in FIG. 1, in some embodiments, each driven element 102, 104 has a radar cross section, at the radar evasion frequency, at least 20 dB below the radar cross section, at the radar evasion frequency, of a hypothetical solid copper driven element 110, 112 having dimensions equal to corresponding dimensions of the driven element 102 or 104.

Figure 21:
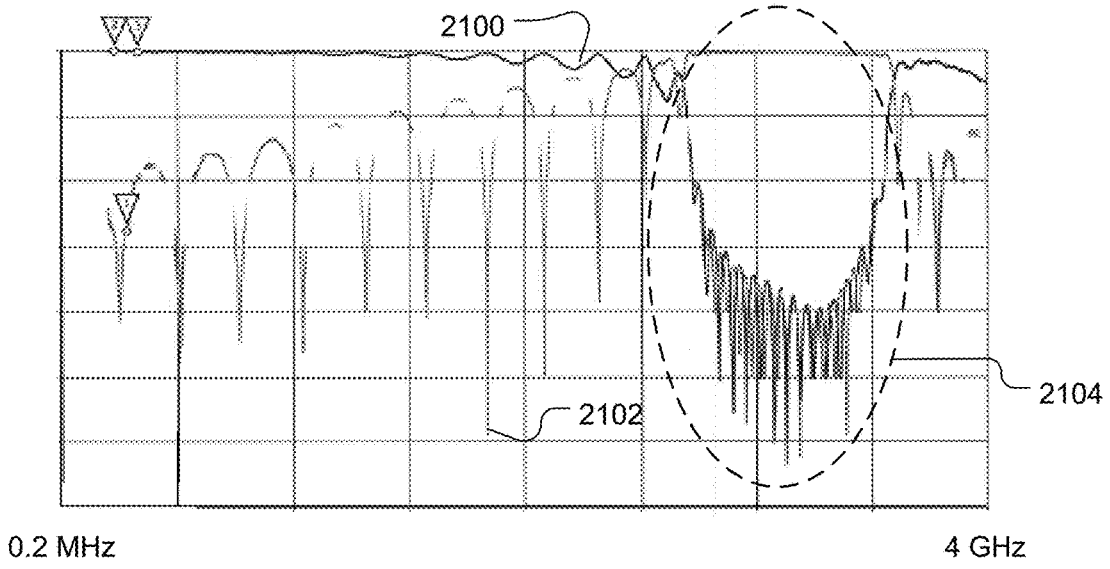
FIG. 21 is a graph of S11 and S21 parameters of the antenna of FIGS. 17 and 18.

In another computer simulation, the frequency selective surface antenna element of the antenna of FIG. 20 was treated as a transmission line. FIG. 21 is a graph of S11 (2102) and S21 (2100) parameters of the computer-simulation between 0.2 MHz and 4 GHz. Plot 2100 represents values of the S21 parameter, showing the passband, while plot 2102 represent values of the S22 parameter, showing the stop band. A dashed line 2104 surrounds the plots in the vicinity of the radar evasion frequency.

Figure 22:
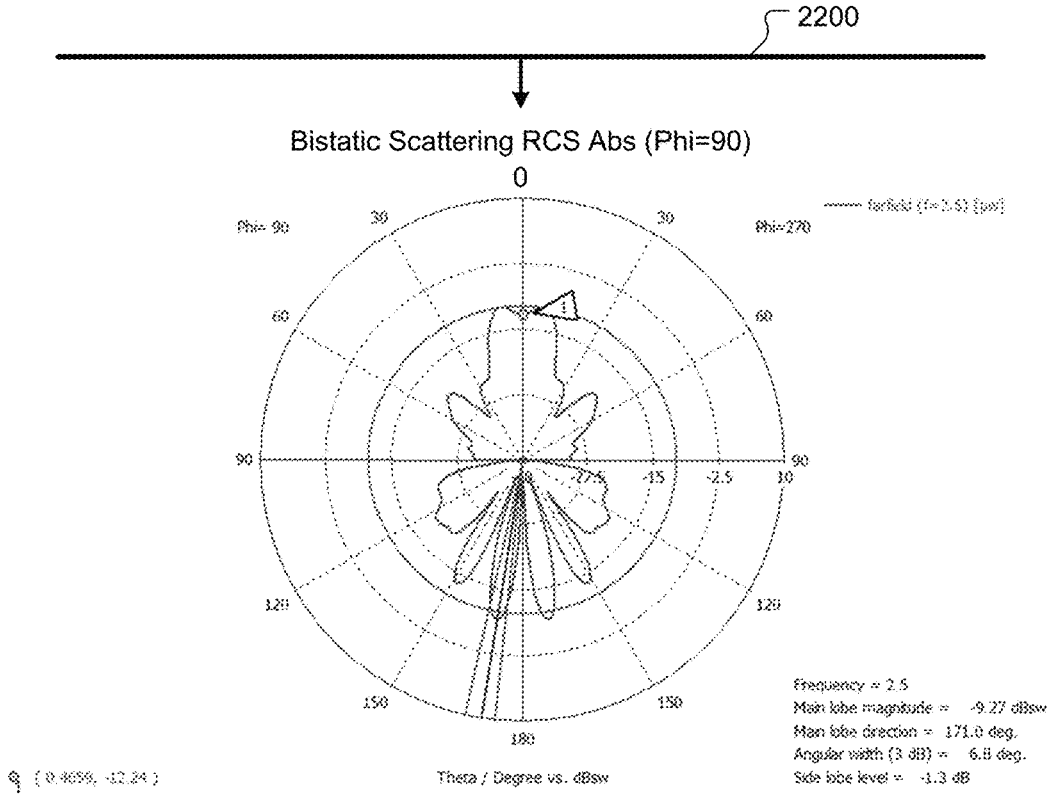
FIG. 22 is an azimuth graph of bistatic scattering radar cross section (RCS) as a result of a plane wave by an antenna made of metallic antenna elements, according to the prior art.
Figure 23:
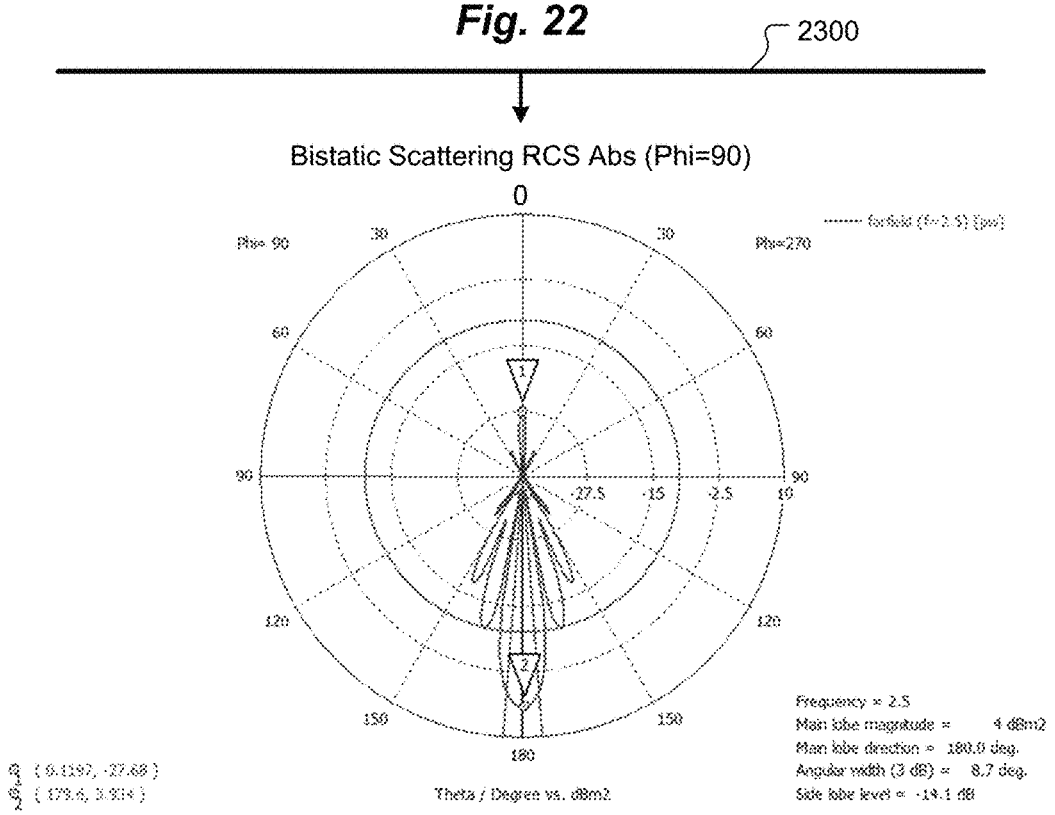
FIG. 23 is an azimuth graph of bistatic scattering radar cross section (RCS) as a result of a plane wave by the antenna of FIGS. 17 and 18.

FIG. 22 is an azimuth graph of bistatic scattering RCS as a result of a plane wave 2200 by a reference structure, i.e., a conventional antenna made of metallic antenna elements. FIG. 23 is an azimuth graph of bistatic scattering RCS as a result of a plane wave 2300 by an antenna made of frequency selective surface antenna elements tuned for 2.5 GHz, as in FIG. 12. The two graphs have identical scales +10 to −40 dBm.

As used herein, a dielectric material is a material having an electrical conductivity no greater than about $10^{-6}$ Ω-m. As used herein, electrically conductive means having an electrical resistance less than about 100 kΩ.

While the invention is described through the above-described exemplary embodiments, modifications to, and variations of, the illustrated embodiments may be made without departing from the inventive concepts disclosed herein. For example, although specific parameter values, such as dimensions and materials, may be recited in relation to disclosed embodiments, within the scope of the invention, the values of all parameters may vary over wide ranges to suit different applications. Unless otherwise indicated in context, or would be understood by one of ordinary skill in the art, terms such as "about" mean within ±20%.

As used herein, including in the claims, the term "and/or," used in connection with a list of items, means one or more of the items in the list, i.e., at least one of the items in the list, but not necessarily all the items in the list. As used herein, including in the claims, the term "or," used in connection with a list of items, means one or more of the items in the list, i.e., at least one of the items in the list, but not necessarily all the items in the list. "Or" does not mean "exclusive or."

Disclosed aspects, or portions thereof, may be combined in ways not listed above and/or not explicitly claimed. In addition, embodiments disclosed herein may be suitably practiced, absent any element that is not specifically disclosed herein. Accordingly, the invention should not be viewed as being limited to the disclosed embodiments.

What is claimed is:

1. A reduced radar cross section antenna having an operating frequency and a radar evasion frequency, the antenna comprising:

at least one driven element, each driven element of the at least one driven element being sized in accordance with the operating frequency and comprising a respective frequency selective surface having a resonant frequency equal to the radar evasion frequency ±30%, wherein:

the radar evasion frequency is electrically adjustable;

each frequency selective surface comprises a respective plurality of resonators, each resonator of the plurality of respective resonators having a resonant frequency equal to the radar evasion frequency ±30%;

each resonator of the plurality of resonators comprises an electrically tunable dielectric material;

the electrically tunable dielectric material has a dielectric constant, the resonant frequency of each resonator of the plurality of resonators depends on the dielectric constant and the dielectric constant is electrically adjustable; and the dielectric constant varies according to a bias voltage applied to the dielectric material, the antenna further comprising:

a first bias electrode disposed proximate the dielectric material and a second bias electrode disposed proximate the dielectric material, the dielectric material being disposed between the first bias electrode and the second bias electrode.

2. An antenna according to claim 1, wherein the radar evasion frequency is at least one order of magnitude greater than the operating frequency.

3. An antenna according to claim 1, wherein the radar evasion frequency is greater than 2 GHz and the operating frequency is between 10 MHz and 2 GHz.

4. An antenna according to claim 1, wherein each driven element of the at least one driven element has a radar cross section, at the radar evasion frequency, at least 20 dB below the radar cross section, at the radar evasion frequency, of a hypothetical solid copper driven element having dimensions equal to corresponding dimensions of one driven element of the at least one driven element.

5. An antenna according to claim 1, wherein:

each resonator of each plurality of resonators comprises a substantially rectangular electrically conductive loop; the antenna further comprising:

a dielectric substrate; and wherein, for each driven element of the at least one driven element:

the driven element has a respective longitudinal axis; and the plurality of resonators of the driven element is arranged in a one-dimensional array on the dielectric substrate, along the longitudinal axis of the driven element.

6. An antenna according to claim 5, wherein the dielectric substrate is sufficiently flexible to be formed into a 3-inch (7.6-cm) diameter loop by an unaided human hand.

7. An antenna according to claim 1, each driven element of the at least one driven element comprises an elongated electrically conductive member defining a plurality of apertures, each aperture of the plurality of apertures sized according to the radar evasion frequency.

8. An antenna according to claim 1, wherein the electrically tunable dielectric material comprises barium strontium titanate.

9. An antenna according to claim 1, wherein the dielectric constant varies according to a temperature of the dielectric material, the antenna further comprising an electrically adjustable heater thermally coupled to the dielectric material.

10. A reduced radar cross section antenna having an operating frequency and a radar evasion frequency, the antenna comprising:

at least one driven element, each driven element of the at least one driven element being sized in accordance with the operating frequency and comprising a respective frequency selective surface having a resonant frequency equal to the radar evasion frequency ±30%, wherein each driven element of the at least one driven element comprises:

a first bias terminal;

a first elongated electrically conductive member electrically coupled to the first bias terminal;

a second bias terminal; and a second elongated electrically conductive member electrically coupled to the second bias terminal and disposed parallel to, and spaced apart from, the first elongated electrically conductive member; wherein:

the first and second elongated electrically conductive members define respective counterfacing sides, and each counterfacing side defines a respective plurality of recesses along a length of the counterfacing side, such that each recess defined by the first elongated electrically conductive member registers, normal to the counterfacing sides, with a corresponding recess defined by the second elongated electrically conductive member, thereby forming a plurality of counterfacing recess pairs; the antenna further comprising:

for each counterfacing recess pair of the plurality of counterfacing recess pairs, a respective dielectric material disposed therein, the first and second elongated electrically conductive members and the dielectric material collectively defining the frequency selective surface.

11. An antenna according to claim 10, wherein the radar evasion frequency is electrically adjustable.

12. An antenna according to claim 10, wherein each frequency selective surface comprises a respective plurality of resonators, each resonator of the plurality of respective resonators having a resonant frequency equal to the radar evasion frequency ±30%.

13. An antenna according to claim 12, wherein each resonator of the plurality of resonators comprises an electrically tunable dielectric material.

14. An antenna according to claim 13, wherein the electrically tunable dielectric material comprises barium strontium titanate.

15. An antenna according to claim 13, wherein the electrically tunable dielectric material has a dielectric constant, the resonant frequency of each resonator of the plurality of resonators depends on the dielectric constant and the dielectric constant is electrically adjustable.

16. An antenna according to claim 15, wherein the dielectric constant varies according to a temperature of the dielectric material, the antenna further comprising an electrically adjustable heater thermally coupled to the dielectric material.

17. An antenna according to claim 10, wherein each frequency selective surface comprises a respective plurality of resonators, each resonator of the respective plurality of resonators having a resonant frequency equal to the radar evasion frequency ±30%.

18. An antenna according to claim 10, wherein each counterfacing recess pair of the plurality of counterfacing recess pairs and the respective dielectric material disposed therein comprise a respective resonator having a resonant frequency equal to the radar evasion frequency ±30%.

19. An antenna according to claim 10, wherein a dielectric constant of the respective dielectric material disposed in each counterfacing recess pair of the plurality of counterfacing recess pairs is electrically tunable, according to a bias voltage applied across the first and second bias terminals.

20. An antenna according to claim 19, wherein the respective dielectric material disposed in each counterfacing recess pair of the plurality of counterfacing recess pairs comprises barium strontium titanate.

21. An antenna according to claim 10, wherein the radar evasion frequency is at least one order of magnitude greater than the operating frequency.

22. An antenna according to claim 10, wherein the radar evasion frequency is greater than 2 GHz and the operating frequency is between 10 MHz and 2 GHz.

23. An antenna according to claim 10, wherein each driven element of the at least one driven element has a radar cross section, at the radar evasion frequency, at least 20 dB below the radar cross section, at the radar evasion frequency, of a hypothetical solid copper driven element having dimensions equal to corresponding dimensions of one driven element of the at least one driven element.

24. An antenna according to claim 18, wherein:

each resonator comprises a substantially rectangular electrically conductive loop; the antenna further comprising:

a dielectric substrate; and wherein, for each driven element of the at least one driven element:

the driven element has a respective longitudinal axis; and the plurality of resonators of the driven element is arranged in a one-dimensional array on the dielectric substrate, along the longitudinal axis of the driven element.

* * * * *